United States Patent [19]

Lavoute et al.

[11] Patent Number: 4,816,718

[45] Date of Patent: Mar. 28, 1989

[54] SEGMENTED PHOTOMULTIPLIER TUBE

[75] Inventors: Pascal D. Lavoute; Jean-Pierre Boutot, both of Brive, France

[73] Assignee: U.S. Philips Corp., New York, N.Y.

[21] Appl. No.: 103,994

[22] Filed: Oct. 1, 1987

[30] Foreign Application Priority Data

Oct. 3, 1986 [FR] France ..... 86 13810

[51] Int. Cl.[4] ..... H01J 43/06; H01J 43/20

[52] U.S. Cl. ..... 313/534; 313/541; 313/544

[58] Field of Search ..... 313/532, 534, 540, , 313/541, 542, 544, 384; 250/213 VJ

[56] References Cited

U.S. PATENT DOCUMENTS

| | | | |
|---|---|---|---|
| 4,446,401 | 5/1984 | Faulkner et al. | 313/532 X |
| 4,523,091 | 6/1985 | Persyk | 313/532 X |
| 4,649,314 | 3/1987 | Eschard | 313/103 R X |

FOREIGN PATENT DOCUMENTS 8311514 1/1985 France .

*Primary Examiner*—David K. Moore
*Assistant Examiner*—Sandra L. O'Shea
*Attorney, Agent, or Firm*—William L. Botjer

[57] ABSTRACT

Photomultiplier tube 10 segmented into a plurality of elementary photomultipliers 11 comprising a photocathode 12 and a multiplier 13 of the type using sheets partitioned into a plurality of elementary multipliers 14. According to the invention the input space of the tube 10 located between the photocathode 12 and the multiplier 13 is partitioned into elementary input spaces 15 associated with the elementary photomultipliers and defining a plurality of elementary photocathodes 16, with each elementary input space 15 having a focussing electrode which causes the photo-electrons emitted by the associated elementary photocathode 16 to converge on the corresponding elementary multiplier 14.

10 Claims, 2 Drawing Sheets

SEGMENTED PHOTOMULTIPLIER TUBE

BACKGROUND OF THE INVENTION

The invention relates to a photomultiplier tube segmented into a plurality of elementary photomultipliers.

One of the technical problems to be solved in the photomultiplier tubes segmented into a plurality of elementary photomultipliers is related to the field of high-energy physics and particularly to the photo-electric detection of elementary particles in order to determine, for example their trajectory. For this purpose it is necessary to realize detection devices comprising a large number of distinct photomultiplier elements which are placed as close as possible together so as to limit the losses of the useful area of these devices. A solution to this technical problem, which has also the advantage of reducing the cost of the above-mentioned detection devices, is generally given by the segmentation of a photomultiplier tube into a plurality of elementary photomultiplier. The fact that several photomultipliers are thus realized in one and the same enclosure contributes to a maximum utilization, without any losses, of the photocathode surface of the photomultiplier tube. The cost price of the photomultiplication channels thus obtained is considerably less than that of an equivalent number of single photomultiplier tubes.

French Patent Application No. 83,11,514 which corresponds to U.S. Pat. No. 4,649,314 describes a particular embodiment of a photomultiplier tube segmented into a plurality of elementary photo multipliers and comprising a photocathode and a multiplier of the type using sheets partitioned in a plurality of elementary multipliers associated with the said elementary photomultipliers. This known segmented photomultiplier tube functions by means of proximity focussing, that is to say that the laminated multiplier is placed in the vicinity of the photocathode. Each elementary multiplier thus cuts up, in an immaterial way, the surface of the photocathode into elementary photocathodes which are perfectly contiguous and without any losses. Although it has the advantage of providing up to 64 measuring channels in one and the same enclosure, this known tube type has the drawback that due to the presence of metallic assembly fittings and electrical contacts at the periphery of the laminated multiplier the useful area of the photocathode is smaller than the overall space of the tube and consequently it is impossible to give such tubes, for example a mosaic structure without creating important zones at the area of their junctions which are insensitive to radiation to be detected. On the other hand the cost of these tubes is still relatively high due to the fact that they require a cumbersome manufacturing technique because the photocathode must be vapour-deposited in vacuum on the exterior of the tube whereafter it is mounted on this tube, which is due to the proximity of the multiplier and the photocathode.

SUMMARY OF THE INVENTION

The technical problem to be solved by way of the object according to the invention is to realize a photomultiplier tube segmented into a plurality of elementary photomultipliers comprising a photocathode and a multiplier of the type using sheets partitioned into a plurality of elementary multipliers associated with the said elementary photomultipliers whereby a useful area of the photocathode is obtained which is better than the useful area of the laminated multiplier and which is substantially equal to the overall space of the tube so that tubes thus realized can be given in mosaic structure without resulting in lost surfaces which are insensitive to incident radiation.

The solution of this technical problem according to the invention is that the input space of the said photomultipler tube, located between the photocathode and the multiplier is partitioned into a plurality of elementary input spaces associated with the elementary photomultipliers and defining a plurality of elementary photocathodes, each elementary input space having a focussing electrode which causes the photo-electrons emitted by the associated elementary photocathode to converge on the corresponding elementary multiplier. This convergence leads to an overall useful surface of the photocathode which is larger than the overall useful surface of the multiplier and which is at least equal to the overall space of the said multiplier. The surface of the photocathode can thus coincide substantially with the space of the tube itself. It is to be noted that the segmented photomultiplier tube according to the invention has the additional advantage that it can be manufactured by using the classic technique of evacuation according to which the photocathode is vapour-deposited after the tube is exhausted and sealed. This low-cost manufacturing technique is made possible because the multiplier is at a relatively large distance from the photocathode.

BRIEF DESCRIPTION OF THE DRAWINGS

The invention will now be described in greater detail by way of example with reference to the accompanying drawings in which.

DETAILED DESCRIPTION OF THE PREFERRED EMBODIMENTS

Figure 1A:
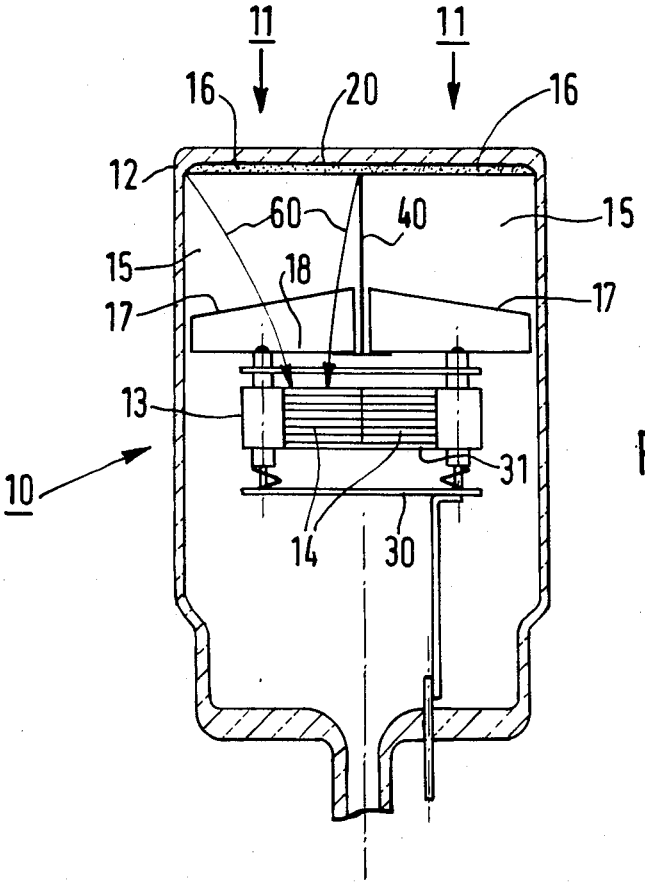
FIG. 1*a* shows in a cross-section a first embodiment of a segmented photomultiplier tube according to the invention.
Figure 1B:
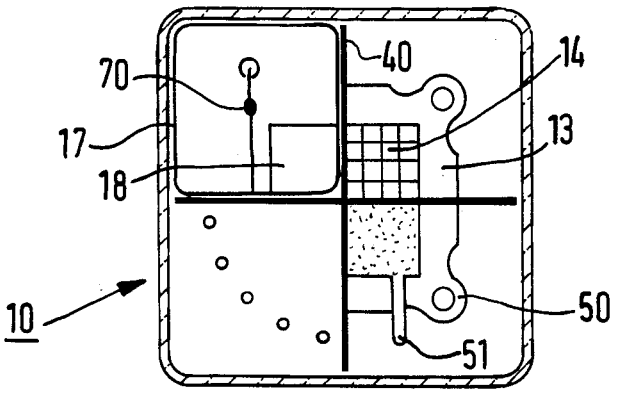
FIG. 1*b* is a plan view corresponding to the cross-sectional view of FIG. 1*a*.

FIGS. 1*a* and 1*b* show in a cross-section and in a plan view, respectively, a photomultiplier tube 10 segmented into four elementary photomultipliers 11. This tube 10 comprises a photocathode 16 deposited on a window 20 and a multiplier 13 of the type using sheets partitioned into four elementary multipliers 14. This type of multiplier and its partitionings are described in detail in French Patent Application No. 83,11,514. The multiplier 13 terminates in a grid anode 30 which can only be utilized as an extracting electrode because the measuring signal is derived at the area of the last sheet 31 of the multiplier which constitutes the last dynode. As is shown in FIGS. 1*a* and 1*b* the input space of the photomultiplier tube 10 situated between the photocathode 12 and the multiplier 13 is partitioned into four elementary input spaces 15 associated with the elementary photomultipliers 11. This partitioning of the input space of the tube 10 is realized with the aid of partitions 40 which are impervious to the electrons and which extend from the photocathode 12 to the input of the laminated multiplier 13 and thus define four elementary photocathodes 16.

As is shown in FIGS. 1*a* and 1*b* the structure of the tube 10 is such that, while taking into account the space occupied by assembly means 50 and electrical contact means 51 for the multiplier 13, the overall space of the tube and thus the surface of the window 20 is considerably larger than the useful multiplication area of the multiplier 13. In order to give the photocathode 12 a useful area which is equal to the surface of the window 20, each elementary input space 15 has a focussing electrode 17 which causes the photo-electrons 60 emitted by the associated elementary photocathode 16 to converge on the corresponding elementary multipier 14.

In order to take for the spatial asymmetry between the elementary photocathode 16 and the corresponding elementary multiplier 14 into account, the focussing electrode 17 has an asymmetrical shape in that it is tapered as is shown in FIG. 1a and in that the output aperture 18 is eccentric with respect to the elementary photocathode 16 so that it is perpendicular above the corresponding elementary multiplier 14. In FIGS. 1*a* and 1*b* all focussing electrodes are identical and are mutually rotated through 90° about the axis of the tube 10.

Since the distance between the laminated multiplier 13 and the photocathode 12 is relatively large, of the order of the dimension of the elementary photocathode 16, it is possible to realize the segmented photomultiplier tube 10 in accordance with the usual low-cost technique which consists of vapour-depositing the photocathode 12 after evacuation and sealing of the tube. For this purpose the evaporators 70 comprising the constituents of the said photocathode (antimony, cesium, etc . . . ) are placed at the bottom of the focussing electrode 17, as is shown in FIG. 1*b*.

Figure 2A:
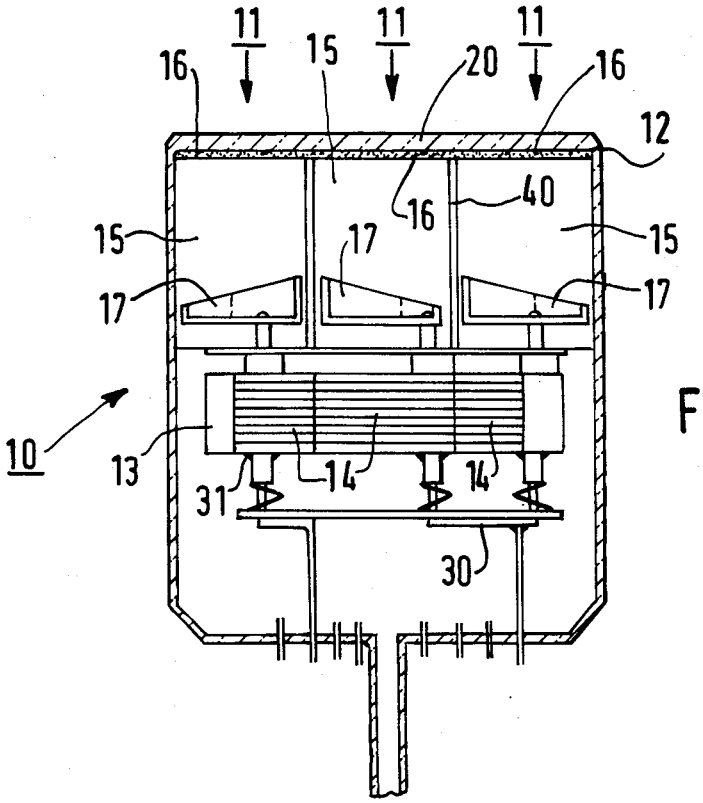
FIG. 2*a* is a cross-section of a second embodiment of a segmented photomultiplier tube according to the invention.
Figure 2B:
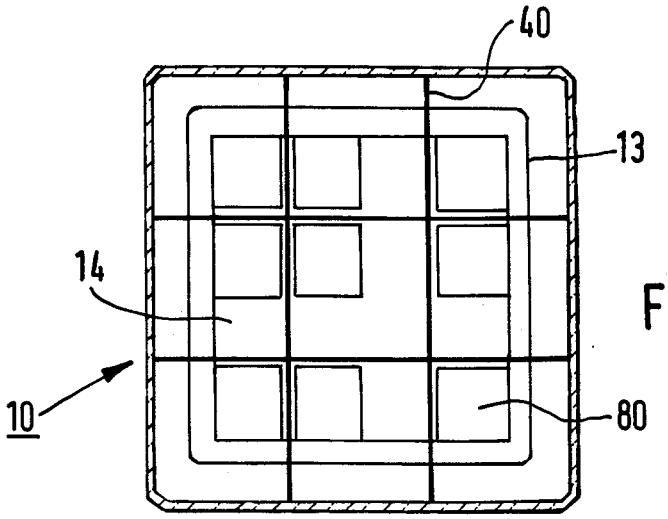
FIG. 2*b* is a plan view corresponding to the cross-sectional view of FIG. 2*a*.

FIGS. 2*a* and 2*b* show also in a cross-section and in a plan view a segmented photomultiplier tube 10 of the same type as described with reference to FIGS. 1*a* and 1*b*. However, the tube of FIGS. 2*a* and 2*b* is segmented into nine elementary photomultipliers 11 instead of four. In this case the nine elementary input spaces 15 are not all equivalent and they are divided into three groups: four situated in the corners of the tube, also four situated in between the four sides and one situated in the centre of the tube. In principle, three types of focussing electrodes 17 can thus be realized ensuring in each of the possible three configurations the convergence of the photo-electrons on the overall useful multiplication area of each elementary multiplier 14. This solution has no industrial advantages and for this reason only a single type of focussing electrode is used, as can be seen in FIGS. 2*a* and 2*b*, namely the electrode corresponding to the focussing electrodes placed in the corners of the tube 10. In this case the overall useful area of the multiplier 13 is not used but only the zones represented by the squares 80 in FIG. 2*b*, which is not disadvantageous for the operation of the segmented photomultiplier 10 shown in FIGS. 2*a* and 2*b*.

What is claimed is:

1. A photomultiplier tube segmented into a plurality of elementary photomultipliers comprising a photocathode and a multiplier of the type using sheets partitioned into a plurality of elementary multipliers associated with the said elementary photomultipliers, characterized in that the input space of the said photomultiplier tube located between the photocathode and the multiplier is partitioned into a plurality of elementary input spaces associated with the elementary photomultipliers and defining a plurality of elementary photocathodes, each elementary input space having a focussing electrode which causes the photo electrons emitted by the associated elementary photocathode to converge on the corresponding elementary multiplier.

2. A segmented photomultiplier tube as claimed in claim 1, characterized in that the focussing electrodes associated with the elementary input spaces are all identical.

3. A photomultiplier tube segmented into a plurality of elementary photomultipliers comprising:

(a) a window for receiving electromagnetic radiation;
(b) a photocathode disposed on said window:
(c) photomultiplier means spaced apart from said photocathode;
(d) photoelectron impervious partitioning means disposed between said photocathode and said photomultiplier means to partition the space between said photocathode and said photomultiplier means into a plurality of elementary photomultipliers; and
(e) each elementary photomultiplier including a focusing electrode disposed between said photocathode and said photomultiplier means to cause the photoelectrons emitted by said photocathode to converge on the corresponding elementary photomultiplier.

4. The photomultiplier tube as claimed in claim 3, wherein said partitioning means divide said tube into four elementary photomultipliers.

5. The photomultiplier tube as claimed in claim 3, wherein said partitioning means divide said tube into nine elementary photomultipliers.

6. The photomultiplier tube as claimed in claim 3, wherein each of said individual focusing electrodes is identically configured.

7. The photomultiplier tube as claimed in claim 3, wherein said focusing electrodes are tapered from a widest point toward the center of said photomultiplier tube.

8. The photomultiplier tube as claimed in claim 3, wherein said focusing electrodes include apertures, the totality of the areas of the apertures of the focusing electrodes being substantially the same as the area of the photomultiplier means.

9. The photomultiplier tube as claimed in claim 3, wherein said surface area of said photocathode is greater than the surface area in plan view of said photomultiplier means.

10. The photomultiplier tube as claimed in claim 3, wherein said photomultiplier means comprise a stack of individual photomultiplier elements.

* * * * *